US010172451B2

(12) United States Patent
Mahugo-Lopez et al.

(10) Patent No.: US 10,172,451 B2
(45) Date of Patent: Jan. 8, 2019

(54) HANGING SHELF SYSTEM

(71) Applicant: GRISEA MATTER, INC., Las Vegas, NV (US)

(72) Inventors: Maria Carmen Mahugo-Lopez, Barcelona (ES); Diego Polognioli, Santa Coloma de Farners (ES)

(73) Assignee: Grisea Matter, Inc., Las Vegas, NV (US)

( * ) Notice: Subject to any disclaimer, the term of this patent is extended or adjusted under 35 U.S.C. 154(b) by 0 days.

(21) Appl. No.: 15/119,891

(22) PCT Filed: Feb. 16, 2015

(86) PCT No.: PCT/IB2015/051138
§ 371 (c)(1),
(2) Date: Aug. 18, 2016

(87) PCT Pub. No.: WO2015/125060
PCT Pub. Date: Aug. 27, 2015

(65) Prior Publication Data

US 2017/0086577 A1 Mar. 30, 2017

Related U.S. Application Data

(60) Provisional application No. 61/941,755, filed on Feb. 19, 2014.

(51) Int. Cl.
*A47B 43/00* (2006.01)
*A47B 75/00* (2006.01)
*A47F 5/08* (2006.01)

(52) U.S. Cl.
CPC ..... *A47B 43/006* (2013.01); *A47B 75/00* (2013.01)

(58) Field of Classification Search
CPC ..... A47B 43/006; A47B 43/003; A47B 2051/005; A47B 75/00; A47F 5/0876; A47F 5/0892; A47F 5/08; E06B 9/02; E06B 9/26; E06B 9/264
USPC .... 211/88.01, 117, 90.01, 90.02, 90.04, 113; 248/327, 328, 317; 160/32, 34
See application file for complete search history.

(56) References Cited

U.S. PATENT DOCUMENTS 293,894 A * 2/1884 Loomis ..... A47B 47/04 108/186
889,844 A * 6/1908 Beach ..... A47B 43/006 108/149
2,206,753 A * 7/1940 Roth ..... A47B 43/006 108/164
2,562,622 A * 7/1951 Laughlin ..... A47G 25/746 211/100
3,799,072 A * 3/1974 Slaboden ..... A47B 43/00 108/107

(Continued)

FOREIGN PATENT DOCUMENTS

DE 10123755 A1 11/2002
EP 0004517 A2 10/1979

(Continued)

*Primary Examiner* — Jennifer E. Novosad
(74) *Attorney, Agent, or Firm* — Knobbe, Martens, Olson & Bear, LLP

(57) ABSTRACT

Hanging shelf system comprising one or more vertical posts and one or more shelves fastened to said vertical posts, characterized in that said vertical posts are supporting cables which suspend from at least one support.

10 Claims, 6 Drawing Sheets

(56) References Cited

U.S. PATENT DOCUMENTS 4,061,092 A * 12/1977 Jacobsen ..... A47B 43/006 108/149
4,295,432 A * 10/1981 Hulke ..... A47B 43/006 108/149
4,317,522 A * 3/1982 Garrett ..... A47F 5/0892 211/113
4,422,492 A * 12/1983 Bledsoe ..... E06B 9/323 160/21
4,523,526 A * 6/1985 O'Neill ..... A47B 43/006 108/149
4,589,351 A * 5/1986 Love ..... A47B 43/006 108/105
4,828,002 A * 5/1989 Ashby ..... E06B 9/323 160/21
4,955,419 A * 9/1990 Morris ..... E06B 9/323 160/178.1 R
4,974,523 A * 12/1990 Giarratana ..... A47B 43/006 108/42
5,176,266 A * 1/1993 Gillet ..... A47B 43/006 108/106
5,427,344 A * 6/1995 Beauchemin ..... A44B 11/125 108/149
5,622,415 A * 4/1997 Felsenthal ..... A47B 43/006 108/110
5,749,479 A * 5/1998 Belokin ..... A47F 5/0892 211/113
6,116,164 A * 9/2000 Justen, Jr. ..... A47B 43/006 108/42
6,354,232 B1 * 3/2002 Hulke ..... A47B 43/003 108/149
6,488,070 B1 * 12/2002 Cox ..... A47K 3/38 160/84.01
6,595,145 B1 * 7/2003 Lietz ..... A47B 43/006 108/106
7,165,688 B2 * 1/2007 Cameron ..... A47G 25/02 160/301
8,672,146 B1 * 3/2014 Cole ..... A47B 43/006 211/117
9,259,082 B2 * 2/2016 Barre ..... A47B 43/003
2002/0056213 A1 * 5/2002 Van Der Meer ..... A47F 5/0892 40/124
2002/0190017 A1 * 12/2002 Stevens ..... A47F 5/0892 211/118
2003/0164347 A1 * 9/2003 Bouvier, Jr. ..... A47B 43/006 211/117
2004/0178706 A1 * 9/2004 D'Orso ..... A47B 61/04 312/351
2005/0023229 A1 * 2/2005 Ashley ..... A47B 61/00 211/38
2006/0120846 A1 * 6/2006 Krengel ..... A47B 5/00 414/592
2006/0186071 A1 * 8/2006 Rowan ..... A47B 43/006 211/113
2007/0114196 A1 * 5/2007 Cameron ..... A47G 25/02 211/113
2010/0213150 A1 * 8/2010 Wang ..... A47G 29/08 211/90.01
2011/0062301 A1 * 3/2011 Sloan ..... A47B 43/003 248/304
2012/0111816 A1 * 5/2012 Mathews ..... A47B 43/006 211/90.02
2012/0292276 A1 * 11/2012 Hoch ..... A47B 43/003 211/90.02
2013/0032560 A1 * 2/2013 Gregory ..... A47B 43/006 211/153
2013/0264300 A1 * 10/2013 Shaffer ..... A47F 5/0006 211/117
2015/0083682 A1 * 3/2015 Barre ..... A47B 43/003 211/118
2017/0086577 A1 * 3/2017 Mahugo-Lopez ... A47B 43/006

FOREIGN PATENT DOCUMENTS

FR 1129305 A 1/1957
FR 2526648 A1 11/1983

* cited by examiner

HANGING SHELF SYSTEM

CROSS-REFERENCE TO RELATED APPLICATIONS

This application is the U.S. National Phase under 35 U.S.C. § 371 of International Application PCT/IB2015/051138, filed Feb. 16, 2015, which claims priority to U.S. Provisional Application 61/941,755, filed Feb. 19, 2014, which are hereby incorporated by reference in their entirety.

FIELD OF THE INVENTION

The present invention relates to shelves, and more particularly, to hanging shelves.

BACKGROUND OF THE INVENTION

Limited space in buildings such apartments, offices, labs, etc., complicate storage of items that need to be accessible and preferably not piled up. For example, fruit baskets and refrigerator drawers are commonly used to store fruit in modern homes. These systems have the disadvantage that fruits are piled on top of each other, which results in the bottom fruits being crushed and/or not visible and going bad before being used. There is a need for versatile shelves that are easily installed, shipped, and capable of storing items for quick access.

An example of a versatile shelf can be found in document U.S. Pat. No. 5,269,419. It discloses a modular shelf system which is robust and allows to make a shelf of virtually any height or length. Shelves, or beams, are supported by vertical posts that are composed of several interconnected pieces.

SUMMARY OF THE INVENTION

Embodiments of the present invention solve this problem by providing hanging shelves that are simple, yet versatile, easy to ship, assemble and install (e.g., with one unique attachment area), and are aesthetically appealing.

In particular, the present application discloses a hanging shelf system comprising one or more vertical posts and one or more shelves fastened to said vertical posts, characterized in that said vertical posts are supporting cables which suspend from at least one support.

One embodiment of the present invention comprises hanging shelf system comprising support, cover, one or more supporting cables, and one or more trays. Preferably, support comprises a plurality of perforations to facilitate fastening onto a surface through, for example, fasteners.

In one embodiment of the invention, support is built to be fastened onto a wall. However, the system may hang from other surfaces depending on its purpose. For example, the support component of the system can be built to for installation onto the ceiling of a room, a window frame, or other suitable places.

Preferably, support comprises grooves for installation of one or more cables. In one embodiment, cables comprise holding stops at their superior end for fastening onto support, and a plurality of stops at predetermined intervals for supporting one or more trays. Optionally, holding stops comprise two parts, e.g., a stop and a safety washer on it to secure the cable in place. In one embodiment, trays comprise perforations through which cables pass. Preferably, trays are fastened to cables with the aid of stops, whose diameter is larger than the diameter of perforations, so that trays can rest on stops after installation. In one embodiment, cover comprises grooves for cables when placed over support.

Preferably, the different components of hanging shelf system are manufactured of suitable materials for the intended purpose of the system. For example, depending on the intended weight load, trays may be manufactured of plastic, aluminum, stainless steel, wood, bamboo, ceramic, stone, glass, etc. Similarly, the support and cover can be manufactured of the same or different material than the trays, and the supporting cables can be stainless steel cables, metal wires, cords, ropes, etc.

In one embodiment of the invention, the system generally comprises an elongated rectangular shape. However, depending on the needs of the user, e.g., the surface against which the system will rest, other shapes are possible. For example, the support, cover, and trays can bend in a 90 degree angle for installation of the system on a corner, or the trays can be circular for installation of the system on a pole. Similarly the number and location of the support cables can differ from one system to another, depending on the intended purpose of the system.

BRIEF DESCRIPTION OF THE DRAWINGS

The accompanying drawings in the attachment, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE PREFERRED EMBODIMENTS

Figure 1:
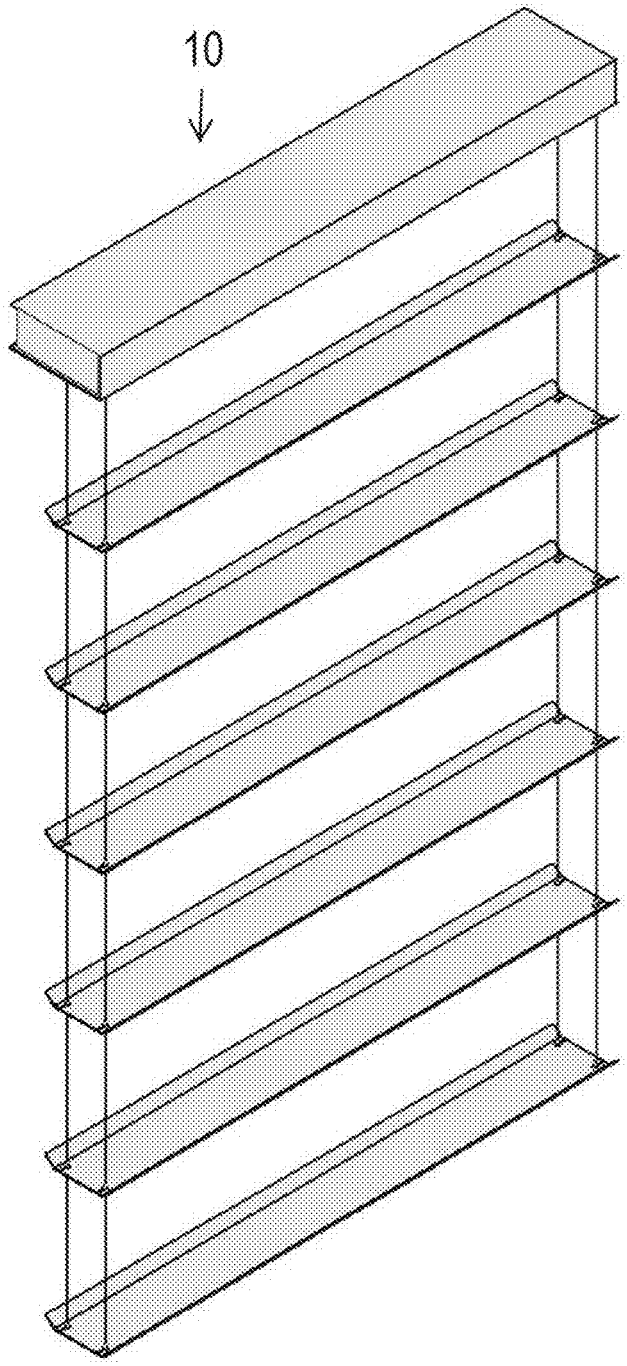
FIG. 1 is a perspective view of an embodiment of a hanging shelf system.

The invention is further illustrated by the following non-limiting examples.

A hanging shelf system was built for the storage of fruit. The cover, trays, and the stops were made of aluminum. The cables that were utilized were made of stainless steel, and the support of steel.

The preceding example can be repeated with similar success by substituting the generically or specifically described components and/or parameters of this invention for those used in the preceding example.

Referring to the Figures, one embodiment of the present invention comprises hanging shelf system 10 comprising support 12, cover 14, one or more supporting cables 16, and one or more trays 18. Support 12 comprises a plurality of perforations 20 to facilitate fastening onto a surface through, for example, fasteners 22.

Figure 2:
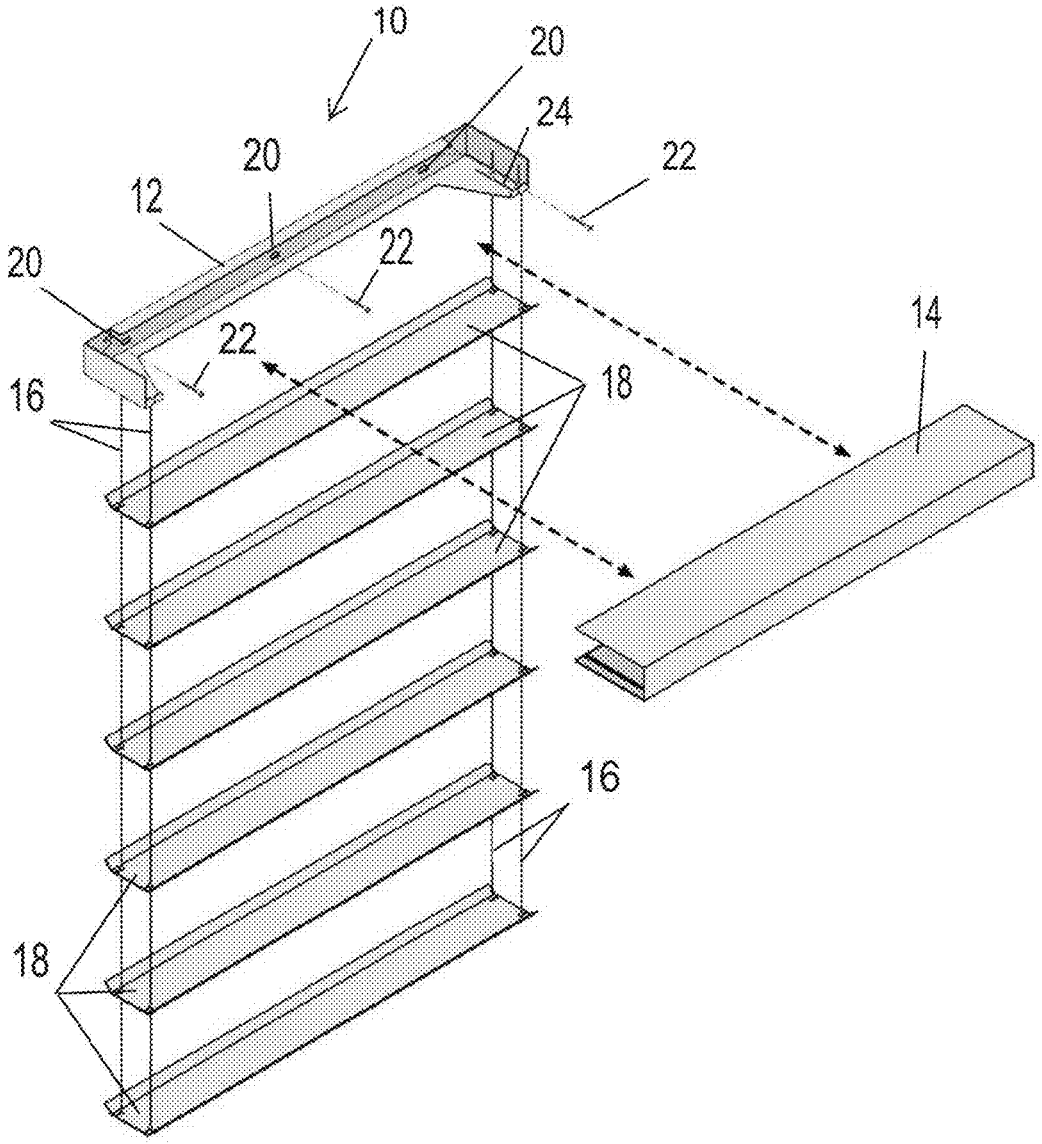
FIG. 2 shows the embodiment of FIG. 1 without the cover.
Figure 3A:
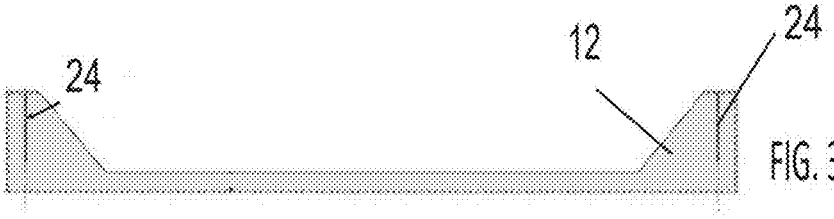
FIG. 3A is a bottom view of the support component of the embodiment of FIG. 1.
Figure 3B:
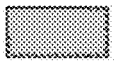
FIG. 3B is a side view of the support component of the embodiment of FIG. 1.
Figure 3C:
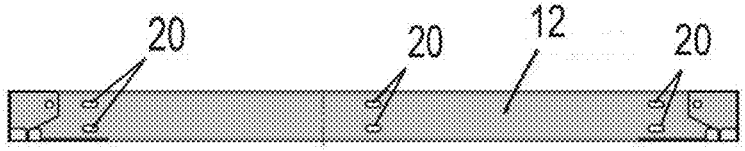
FIG. 3C is a front view of the support component of the embodiment of FIG. 1.
Figure 3D:
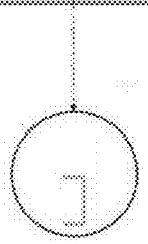
FIG. 3D is a cross-sectional view of the support component of the embodiment of FIG. 1.
Figure 3F:
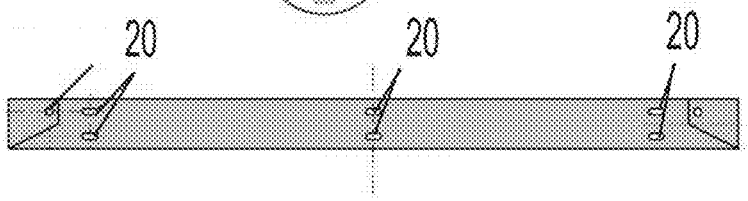
FIG. 3F is a back view of the support component of the embodiment of FIG. 1.
Figure 3G:
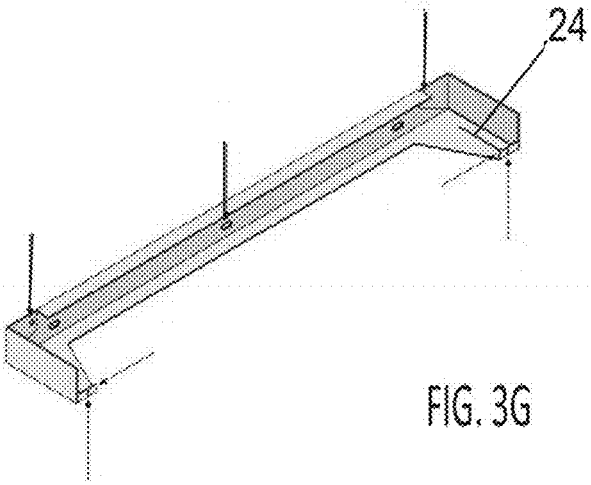
FIG. 3G is a perspective view of the support component of the embodiment of FIG. 1.
Figures 6A, 6B:
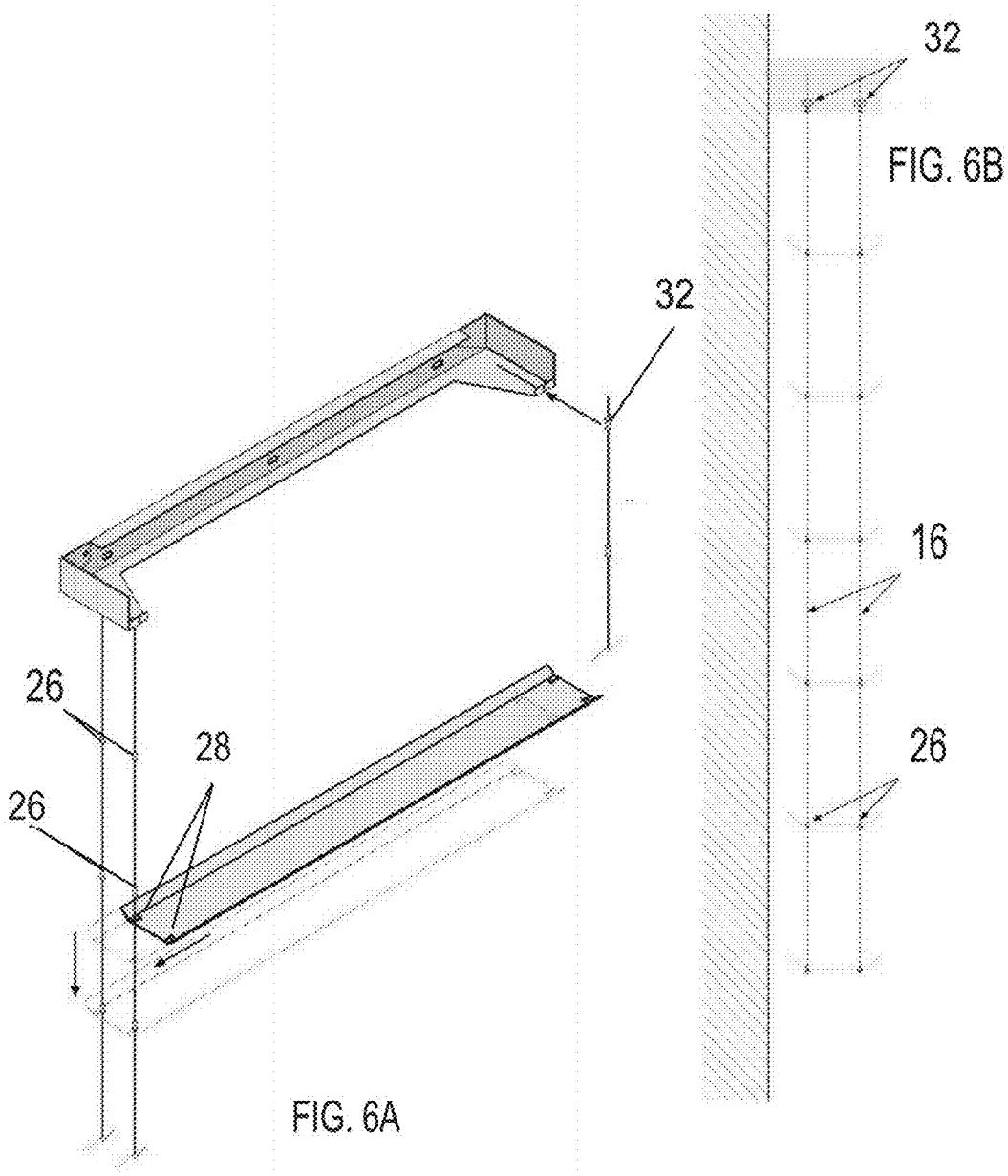
FIG. 6A shows the placement of a tray onto support cables.
FIG. 6B is a side view of the embodiment of FIG. 1 installed on a wall.

In one embodiment of the invention shown in the Figures, support 12 is built to be fastened onto a wall. See FIGS. 2 and 6B.

Figure 4A:
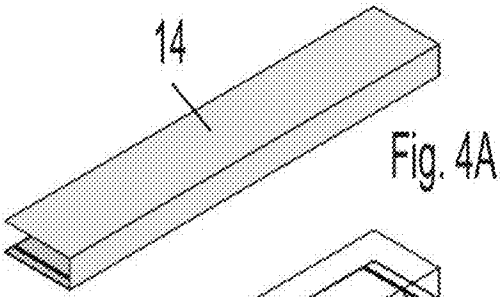
FIG. 4A is a perspective top view of the cover component of the embodiment of FIG. 1.
Figure 4B:
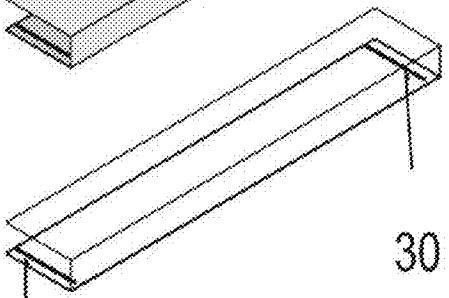
FIG. 4B is a ghost view of FIG. 4A showing grooves for support wires.
Figure 4C:
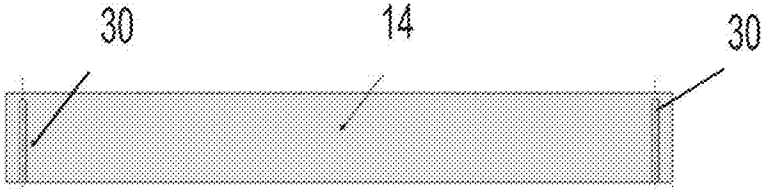
FIG. 4C is a bottom view of the cover component of the embodiment of FIG. 1.
Figure 4D:
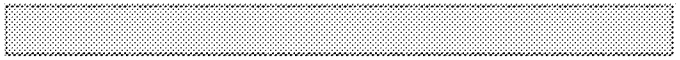
FIG. 4D is a front view of the cover component of the embodiment of FIG. 1.
Figure 4E:
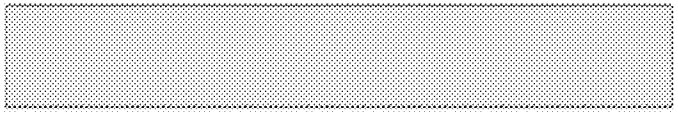
FIG. 4E is a top view of the cover component of the embodiment of FIG. 1.
Figure 4F:
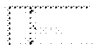
FIG. 4F is a side view of the cover component of the embodiment of FIG. 1 with the opposite side being a mirror image of the same.
Figure 5A:
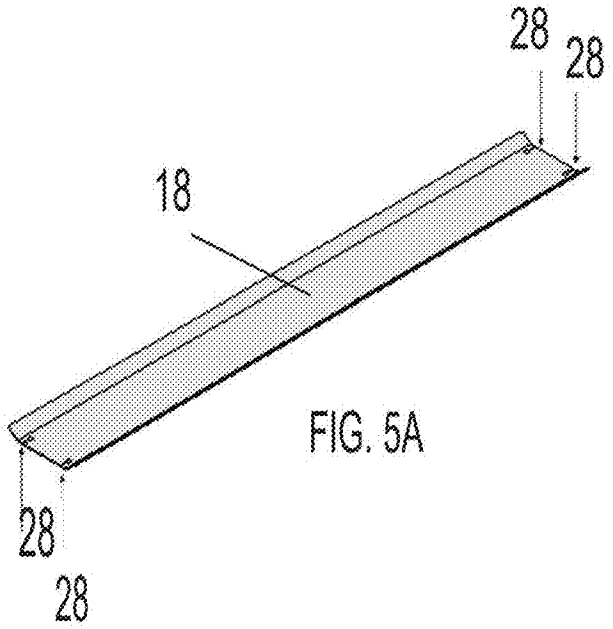
FIG. 5A is a perspective top view of a tray of the embodiment of FIG. 1.
Figure 5B:
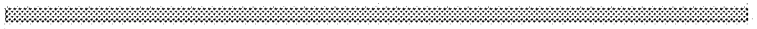
FIG. 5B is a front view of a tray of the embodiment of FIG. 1 with the back view being the same.
Figure 5C:
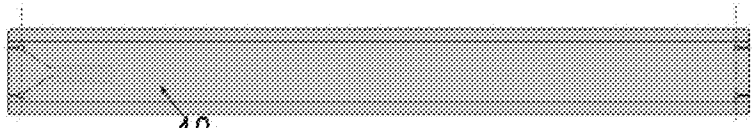
FIG. 5C is a top view of a tray of the embodiment of FIG. 1 with the bottom view being significantly the same.
Figure 5D:
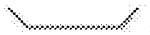
FIG. 5D is a side view of a tray of the embodiment of FIG. 1 with its opposite side being the same.

In the embodiment of the Figures, support 12 comprises grooves 24 for installation of one or more cables 16. In one embodiment, cables 16 comprise holding stops 32 at their superior end for fastening onto support 12, and a plurality of stops 26 at predetermined intervals for supporting one or more trays 18. See FIGS. 6A and 6B. Preferably, the stops 26 for the trays and the stops 32 the support 32 are identical elements. Optionally, holding stops 32 comprise two parts, e.g., a stop 26 and a safety washer on it to secure the cable in place. In one embodiment, trays 18 comprise perforations 28 through which cables 16 pass. Preferably, trays 18 are fastened to cables 16 with the aid of stops 26, whose diameter is larger than the diameter of perforations 28, so that trays 18 can rest on stops 26 after installation. See FIG. 4A. In one embodiment, cover 14 comprises grooves 30 for cables 16 when placed over support 12. See FIGS. 2, 4B, and 4C.

Although the invention has been described in detail with particular reference to these preferred embodiments, other embodiments can achieve the same results. Variations and modifications of the present invention will be obvious to those skilled in the art and it is intended to cover all such modifications and equivalents.

What is claimed is:

1. A hanging shelf system comprising:

a support, one or more supporting cables which suspend from said support, one or more trays fastened to said one or more supporting cables, and a cover comprising grooves for said one or more supporting cables, wherein the cover surrounds at least three sides including a top and a bottom sides of the support, said grooves are open at an edge of the cover, and said support comprises a plurality of perforations to facilitate fastening onto a surface through fasteners.

2. The hanging shelf system according to claim 1 wherein said support is configured to be directly fastened onto a wall.

3. The hanging shelf system according to claim 1 wherein said support comprises grooves for installation of said one or more supporting cables.

4. The hanging shelf system according to claim 1 wherein each tray comprises perforations through which the one or more supporting cables pass.

5. The hanging shelf system according to claim 1 wherein a diameter of a plurality of stops is larger than that of perforations in the one or more trays and said one or more trays rest on the respective plurality of stops of the one or more supporting cables.

6. The hanging shelf system according to claim 1 wherein: the one or more trays, the support, and the cover are made of material selected from the group consisting of plastic, aluminum, stainless steel, wood, bamboo, ceramic, stone, and glass, the support and the cover comprise the same or different material than the one or more trays, and the one or more supporting cables are made of material selected from the group consisting of stainless steel cables, metal wires, cords, and ropes.

7. The hanging shelf system according to claim 1 wherein said system is generally in an elongated rectangular shape.

8. The hanging shelf system according to claim 1 wherein the support is configured to be fastened onto a ceiling.

9. A hanging shelf system comprising:

a support, one or more supporting cables which suspend from said support, one or more trays fastened to said one or more supporting cables, and a cover comprising grooves for said one or more supporting cables, wherein the cover surrounds at least three sides including a top and a bottom sides of the support, said grooves are open at an edge of the cover, each supporting cable comprises a holding stop at a superior end for fastening onto said support, and a plurality of stops at predetermined intervals for supporting said one or more trays.

10. The hanging shelf system according to claim 9 wherein said holding stop comprises a stop and a safety washer on said stop to secure the corresponding one or more supporting cables in place.

* * * * *